US006520366B1

(12) United States Patent
Bradley et al.

(10) Patent No.: US 6,520,366 B1
(45) Date of Patent: Feb. 18, 2003

(54) BEVERAGE CONTAINER HOLDERS

(76) Inventors: Vincent H. Bradley, 11715 Pine Forest, Dallas, TX (US) 75230; Roger D. Chafin, 3761 Park Pl., Addison, TX (US) 75001-4402; Charles M. Armstrong, 3776 Park Pl., Addison, TX (US) 75001

( * ) Notice: Subject to any disclaimer, the term of this patent is extended or adjusted under 35 U.S.C. 154(b) by 0 days.

(21) Appl. No.: 09/537,896

(22) Filed: Mar. 28, 2000

(51) Int. Cl.[7] ..... B65D 21/02
(52) U.S. Cl. ..... 220/23.2; 220/23.4; 220/23.6
(58) Field of Search ..... 220/23.2, 23.4, 220/23.6, 23.87, 23.88, 507, 737, 738, 739, 903

(56) References Cited

U.S. PATENT DOCUMENTS

| | | | | | |
|---|---|---|---|---|---|
| 163,355 | A | | 5/1875 | Boteler | 220/23.8 |
| 586,195 | A | * | 7/1897 | Monroe | 220/23.4 |
| 2,052,801 | A | * | 9/1936 | Russakov | 211/77 |
| 3,008,702 | A | | 11/1961 | Breneman | 220/23.8 |
| 3,115,266 | A | | 12/1963 | Poupitch | 220/23.8 |
| 3,498,470 | A | | 3/1970 | Thomas | 211/74 |
| 3,504,832 | A | | 4/1970 | Corvetti | 224/48 |
| D256,201 | S | | 8/1980 | Ventura | D6/199 |
| D291,957 | S | | 9/1987 | Stevens | D7/70 |
| 4,732,274 | A | | 3/1988 | Bouton | 206/561 |
| 4,744,597 | A | | 5/1988 | Bauman | 294/172 |
| D297,799 | S | | 9/1988 | Hammer | D7/70 |
| 4,989,742 | A | | 2/1991 | Powell | 220/23.4 |
| D317,102 | S | | 5/1991 | Clark | D7/549 |
| D326,588 | S | | 6/1992 | Meisel | D7/549 |
| 5,118,063 | A | | 6/1992 | Young | 248/311.2 |
| D331,860 | S | | 12/1992 | Stanfield | D7/549 |
| 5,219,419 | A | | 6/1993 | Prothe | 206/515 |
| D338,374 | S | | 8/1993 | Jacobson | D7/553 |
| 5,259,528 | A | | 11/1993 | Pace et al. | 220/575 |
| 5,335,787 | A | | 8/1994 | Finchum | 206/564 |
| 5,335,814 | A | | 8/1994 | Hepp | 220/509 |
| 5,346,070 | A | | 9/1994 | McSpadden | 206/561 |
| D351,085 | S | | 10/1994 | Schmidt | D7/507 |
| D352,205 | S | | 11/1994 | Swetharanyam | D7/554 |
| D354,201 | S | | 1/1995 | Van de Gaaf | D7/555 |
| D356,471 | S | | 3/1995 | Corsi | D7/553 |
| 5,421,459 | A | | 6/1995 | Mazzotti | 206/549 |
| 5,624,052 | A | | 4/1997 | Caldi | 220/575 |
| 5,704,671 | A | * | 1/1998 | Van Der Wal et al. | 294/31.2 |
| 5,971,139 | A | | 10/1999 | Bradley | 206/217 |

FOREIGN PATENT DOCUMENTS

| | | | |
|---|---|---|---|
| BE | 670128 | 10/1965 | 206/518 |

* cited by examiner

*Primary Examiner*—Mickey Yu
*Assistant Examiner*—Troy Arnold
(74) *Attorney, Agent, or Firm*—John M. Harrison

(57) ABSTRACT

Beverage container holders which typically include a single-cup beverage container holder, a dual-cup beverage container holder, a three-cup beverage container holder and a four-cup beverage container holder. The respective beverage container holders are each characterized by at least one container cup and a handle attached to the container cup, which handle is typically hollow and serrated or scalloped to facilitate non-rotatable nesting of the handles of two or more of the beverage container holders in either stored or functional configuration. The various configurations of the container cups on the handles facilitates selective positioning of the container cups of multiple nested beverage container holders, to enable an individual to carry a selected number of beverages using one hand at the nested handles. In another embodiment, a dual tray characterized by a pair of typically recessed and/or planar tray surfaces extending from a common serrated handle can be used alone to carry food, or in handle-nested combination with one or more of the beverage container holders for carrying both food and a drink or drinks using one hand.

3 Claims, 8 Drawing Sheets

BEVERAGE CONTAINER HOLDERS

FIELD OF THE INVENTION

This invention relates to beverage container holders and more particularly, to a single-cup beverage container holder, a dual-cup beverage container holder, a three-cup beverage container holder and a four-cup beverage container holder which may be used individually or in combination with each other to facilitate carrying at least one and selectively, multiple beverage-filled containers by an individual using one hand. The respective beverage container holders are each characterized by a handle having one, two, three or four container cups which extend outwardly from the handle in selected spaced-apart configurations with respect to each other. The hollow handle is typically characterized by multiple longitudinal handle serrations which interlock with the handle serrations of one or more additional beverage container holders in handle-nesting configuration to facilitate non-rotatable nesting of the beverage container holders in either stored or functional configuration. The various spatial configurations of the container cups on the handles facilitates selective positioning of the container cups of multiple handle-nested beverage container holders, to enable an individual to carry a selected number of beverage containers using one hand. In another embodiment, a dual tray characterized by a pair of typically recessed, and/or planar tray surfaces extending from a common serrated handle can be used alone to carry a plate or plates of food, or in handle-nested combination with one or more of the beverage container holders for carrying both food and a selected number of drinks, using one hand.

DESCRIPTION OF THE PRIOR ART

At sporting events and gatherings and at fast food restaurants, when a person needs to carry several drinks, it is frequently very difficult to manage these drinks at one time, especially if there is food to be carried also. Many beverage trays have been designed to carry several drinks, but invariably, these require the use of both hands. Indeed, most of these prior art beverage carriers have one or more additional disadvantages.

Many of the prior art beverage container holders are flimsy, unwieldy and unstable. Some of the holders must be placed on a supporting surface before any of the beverage containers can be removed from the holder. Also, very few, if any, food and beverage container holders have been designed to hold multiple beverage containers and/or food items in one hand, leaving the other hand free for other activities. These prior art designs are difficult to hold without spilling the beverages, particularly with the arms extended or held high. Furthermore, many of the designs cannot be nested into one another for storage and none can be nested with drinks in place. Thus, there has been a long-felt need for an improved beverage container holder.

It is an object of this invention to provide at least one single-cup beverage container holder which includes a handle and a single container cup attached to the handle for carrying a glass, bottle, can or cup of beverage, wherein multiple single-cup beverage container holders can be nested at the handles thereof to facilitate carrying two, three, four or more beverages using one hand.

Another object of this invention is to provide a dual-cup beverage container holder which may be characterized by a pair of single-cup beverage container holders removably nested together at the hollow handles, each of which single-cup beverage container holders includes a container cup attached to a handle, or which dual-cup beverage container holder may be characterized by a pair of container cups attached to a common handle.

Yet another object of this invention is to provide a three-cup beverage container holder which may be a composite of three single-cup beverage container holders nested at the hollow handles and having a total of three available beverage container-carrying container cups; two dual-cup beverage container holders nested at the handles and at one ol the container cups of each and having the same number and configuration of container cups available for carrying three glasses, bottles, cans, cups or other containers of beverage in one hand; or a dual-cup beverage container holder and a single-cup beverage container holder nested at the handles and having three beverage container-carrying container cups. Alternatively, the three-cup beverage container holder may be designed such that a single handle supports three extending container cups to facilitate the same carrying capacity, two of which three-cup beverage container holders can be handle-nested to form a six-cup beverage container holder having a total of six available container cups for receiving six beverage containers, respectively.

A still further object of this invention is to provide a four-cup beverage container holder which can, in a first embodiment, be characterized by four single-cup beverage container holders joined and nested at the hollow handles thereof, and having a total of four container cups extending radially from the nested handles for receiving four glasses, cans, bottles, cups or other containers of beverage, respectively. In another embodiment, a single-cup beverage container holder can be handle-nested with a three-cup beverage container holder to form a total of four of the container cups extending radially from the common nested handle. In still another embodiment, the four-cup beverage container holder can be characterized by two of the single-cup beverage container holders handle-nested with a dual-cup beverage container holder and forming four available container cups for receiving four beverage containers, respectively. In a still further embodiment the four-cup beverage container holder can be characterized by a pair of dual-cup beverage container holders nested at the handles thereof for carrying four beverage containers. In yet another embodiment, the four-cup beverage container holder is characterized by a single handle which supports four container cups extending radially from the handle for achieving the same purpose.

It is yet another object of this invention to provide single-cup, dual-cup, three-cup and four-cup beverage container holders, selected combinations of which may be used interchangeably with the individual beverage container holders to facilitate carrying a desired number of drinks with one hand, which selected combinations of the beverage container holders are achieved by nesting the beverage container holders at the hollow handles to facilitate the nested beverage container holders having a selected number of container cups extending from a common nested handle assembly which can be gripped with one hand, each of which container cups is suitably adapted for containing a glass, bottle, can, cup or other container of beverage.

Another object of this invention is to provide single-cup, dual-cup, three-cup and four-cup beverage container holders each characterized by a handle having one, two, three or four container cups, respectively, extending from the common handle for carrying a corresponding number of beverage containers, which handle is characterized by multiple longitudinal internal handle serrations which interlock with the handle serrations of one or more additional beverage container holders in handle-nesting configuration to facilitate non-rotatable nesting of the beverage container holders in selected stored or functional configurations. The various functional configurations of the container cups on the handles facilitates selective spatial arrangement of the container cups of multiple nested beverage container holders, to enable carrying of a selected number of beverage containers using one hand.

A still further object of this invention is to provide a dual tray characterized by a pair of typically recessed, and/or planar tray surfaces extending from a common serrated, hollow handle for receiving a plate or plates of food, which dual tray can be used either alone or in selected handle-nested combinations with one or more of the single-cup or dual-cup beverage container holders, to facilitate carrying food or both food and a selected number of drinks with one hand.

SUMMARY OF THE INVENTION

These and other objects of the invention are provided in single-cup, dual-cup, three-cup and four-cup beverage container holders which may be used individually or in selected combinations with each other to effect nesting of the handles of the respective hollow beverage container holders and forming of a radial array of a selected number of container cups which may he used to carry a corresponding number of beverage containers using one hand. Accordingly, two or more single-cup beverage container holders may be nested at the handles thereof to define two or more beverage container-receiving container cups having nested handles that may be carried in one hand. Similarly, two dual-cup beverage container holders may likewise be nested to form three or more beverage container-receiving container cups which may likewise be carried at the common nested handles. Likewise, one three-cup beverage container holder can be utilized to carry three beverage containers, or four or more beverage containers in corresponding container cups when fitted in handle-nesting configuration with a single-cup, dual-cup or three-cup beverage container holder, respectively. Similarly, the four-cup beverage container holder can be utilized to carry four beverage containers. The handle of each single-cup, dual-cup, three-cup and four-cup beverage container holder is typically characterized by multiple, longitudinal, internal and external handle serrations which interlock with the handle serrations of one or more additional beverage container holders in handle-nesting configuration, to facilitate non-rotatable handle-nesting of the beverage container holders in selected stored or functional configurations. In another embodiment, a dual tray characterized by a pair of typically, recessed and/or planar tray surfaces which extend from a common, internally and externally serrated handle for receiving a plate or plates of food can be used alone for carrying food, or in selected nested combinations with one or more of the beverage container holders for carrying both food and a selected number of beverage-filled containers.

BRIEF DESCRIPTION OF THE DRAWINGS

The invention will be better understood by reference to the accompanying drawings, wherein.

DESCRIPTION OF THE PREFERRED EMBODIMENTS

Figure 1:
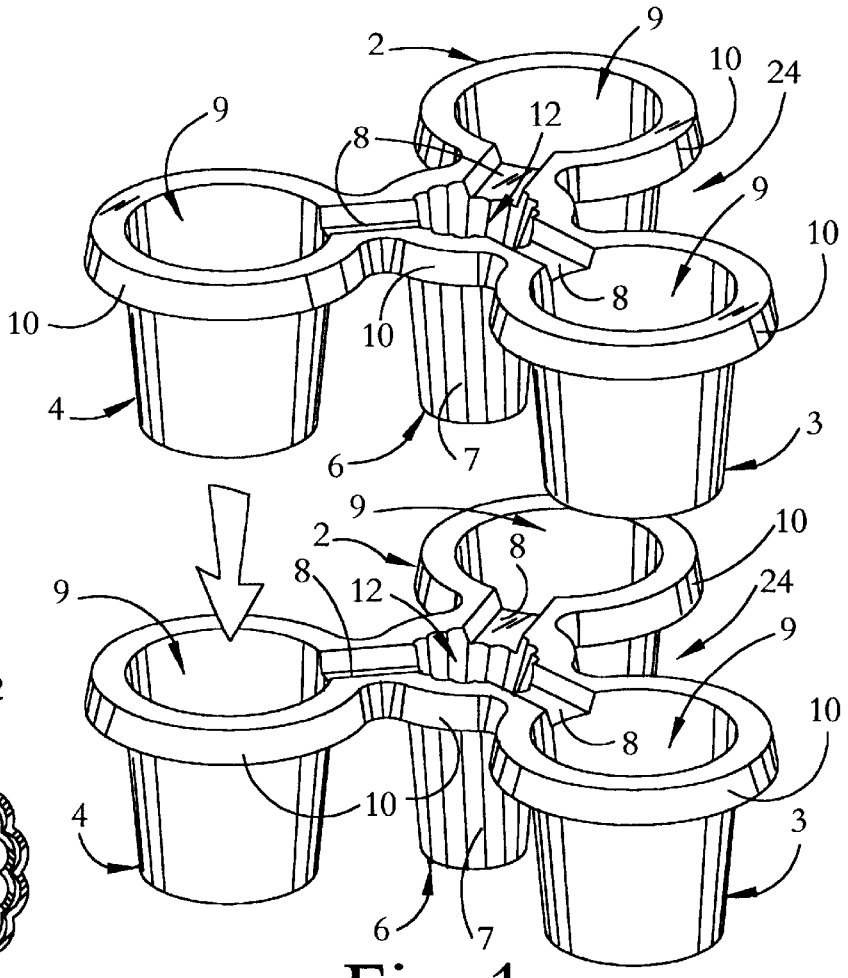
FIG. 1 is a perspective view of a pair of three-cup beverage container holders, positioned for nesting in a storage configuration.

Referring initially to FIGS. 2 and 8–10 of the drawings, in a preferred embodiment the single-cup beverage container holder of this invention is generally illustrated by reference numeral 1. The single-cup beverage container holder 1, typically constructed of plastic, is characterized by a typically frustro-conical first container cup 2 which is joined to a hollow, typically frustro-conical handle 6, having a handle interior 12. The container cup 2 has a cup interior 9, sized to hold a can, cup, bottle, glass or other container of beverage (not illustrated). The upper edges of the first container cup 2 and handle 6 typically extend outwardly and downwardly to form a continuous, stiffening cup and handle border 10, a portion of which joins the first container cup 2 and handle 6. An indentation 8 is typically provided in the joining portion of the cup and handle border 10, between the cup interior 9 of the first container cup 2 and handle interior 12 of the handle 6 to further reinforce the connection between the first container cup 2 and handle 6. The indentation 8 prevents inadvertent bending of the joining portion of the cup and the reinforcing handle border 10, due to the weight of a beverage-filled container (not illustrated), carried in the first container cup 2 as the handle 6 is gripped, as hereinafter described and also allows finger access for removing cups from the respective container cups. Multiple serrations 7 are typically shaped longitudinally in the handle 6, for purposes which will be hereinafter described. Accordingly, in one application of the single-cup beverage container 1 a glass, can, bottle, cup or other container (not illustrated) of beverage can be placed in the cup interior 9 of the first container cup 2, and the handle 6 gripped with one hand to hold and carry the beverage container in the attached first container cup 2.

Figure 2:
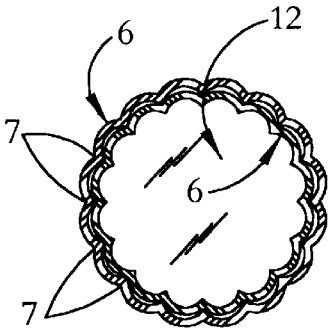
FIG. 2 is a sectional view, taken along section line 2—2 of the nested handle portions of the three-cup beverage container holders illustrated in FIG. 3.
Figure 8:
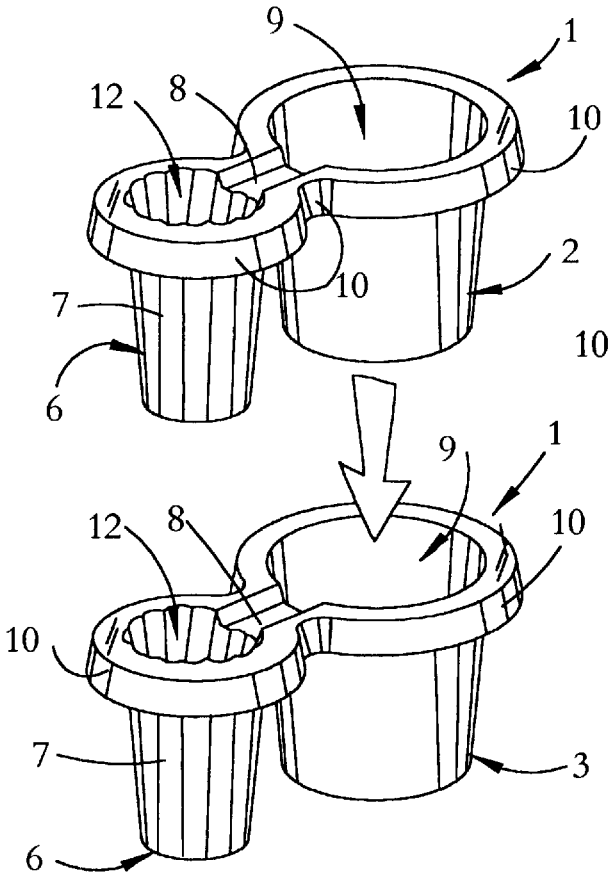
FIG. 8 is a perspective view of a pair of single-cup beverage container holders, positioned for nesting in stored configuration.
Figure 9:
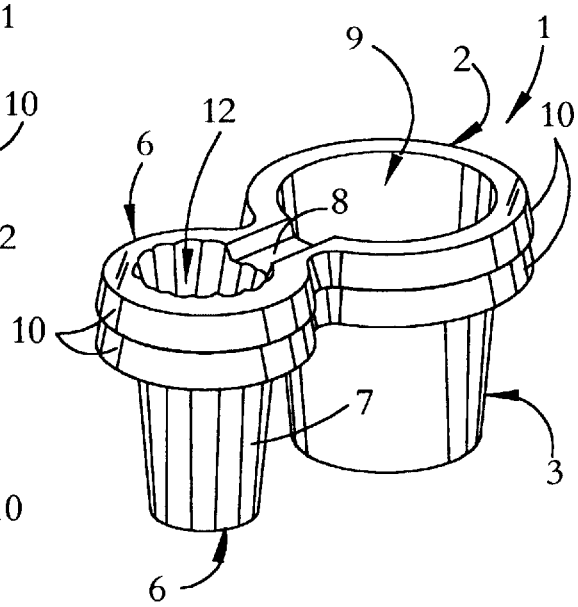
FIG. 9 is a perspective view of the single-cup beverage container holders illustrated in FIG. 8, in nested configuration for storage.
Figure 10:
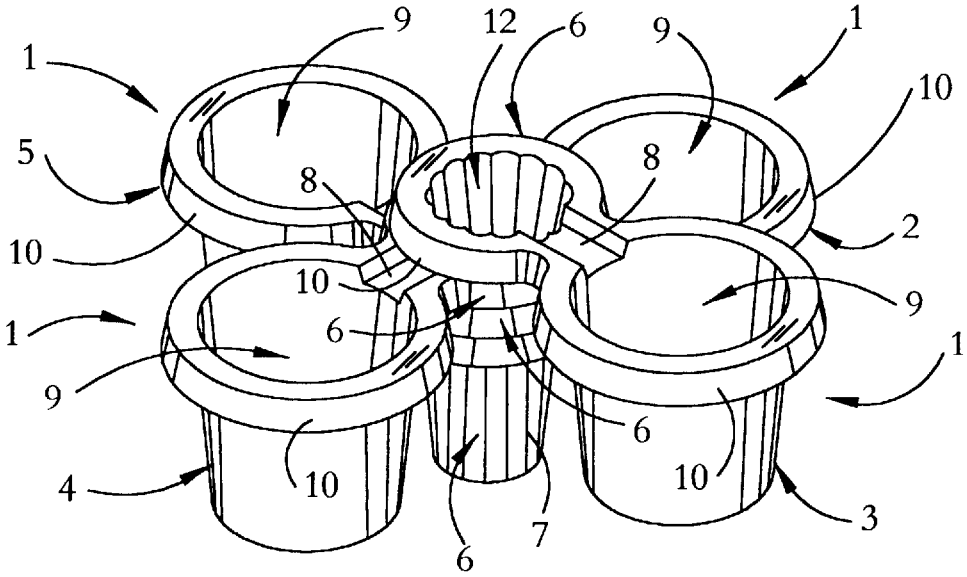
FIG. 10 is a perspective view of four of the single-cup beverage container holders illustrated in FIGS. 8 and 9, nested at the handles to facilitate a radial array of four container cups for receiving four respective beverage drinks or containers which may be carried by one hand at the common nested handles.

As illustrated in FIG. 9, two or more of the single-cup beverage container holders 1 can be nested into a storage configuration, as desired. This is accomplished by inserting the first container cup 2 of one of the single-cup beverage container holders 1 into the cup interior 9 of a second container cup 3 of the underlying single-cup beverage container holder 1, and simultaneously inserting the handle 6 of the upper single-cup beverage container holder 1 into the congruent handle interior 12 of the handle 6 of the underlying single-cup beverage container holder 1, as illustrated in FIG. 8. Alternatively, as illustrated in FIG. 10 the handles 6 of four of the single-cup beverage container holders 1 can be nested to form a handle-nested assembly of the four single-cup beverage container holders 1, having a first container cup 2, a second container cup 3, a third container cup 4 and a fourth container cup 5 extending radially from the common nested handles 6, in spaced-apart, adjacent relationship with respect to each other for carrying four beverage containers in the respective container cups 2–5. Nesting of the single-cup beverage container holders 1 in functional, multiple beverage container-carrying configuration is accomplished by inserting the handle 6 of each single-cup beverage holder 1 into the handle interior 12 of the underlying single-cup beverage container holder 1, with the first container cup 2, second container cup 3, third container cup 4 and fourth container cup 5 of the respective single-cup beverage container holders 1 positioned in staggered, adjacent relationship with respect to each other, as illustrated in FIG. 10. As illustrated in FIG. 2, the serrations 7 of each handle 6 interlock with the adjacent serrations 7 of the underlying, receiving handle 6, in order to prevent rotation of the respective single-cup beverage container holders 1 with respect to each other at the nested handles 6, and thus substantially lock the respective container cups 2–5 in the selected positions with respect to each other. Accordingly, four glasses, cans, bottles, cups or other containers of beverage (not illustrated) can be securely held in the respective first container cup 2, second container cup 3, third container cup 4 and fourth container cup 5, as the nested handles 6 of the single-cup beverage container holders 1 are gripped and carried using one hand. It will be appreciated by those skilled in the art that two, three or four of the single-cup beverage container holders 1 can be handle-nested as described above with respect to FIG. 10, to provide a corresponding number of the first container cup 2, second container cup 3, third container cup 4 and fourth container cup 5 for carrying two, three or four beverage containers, respectively, with one hand at the nested handles 6.

Figure 11:
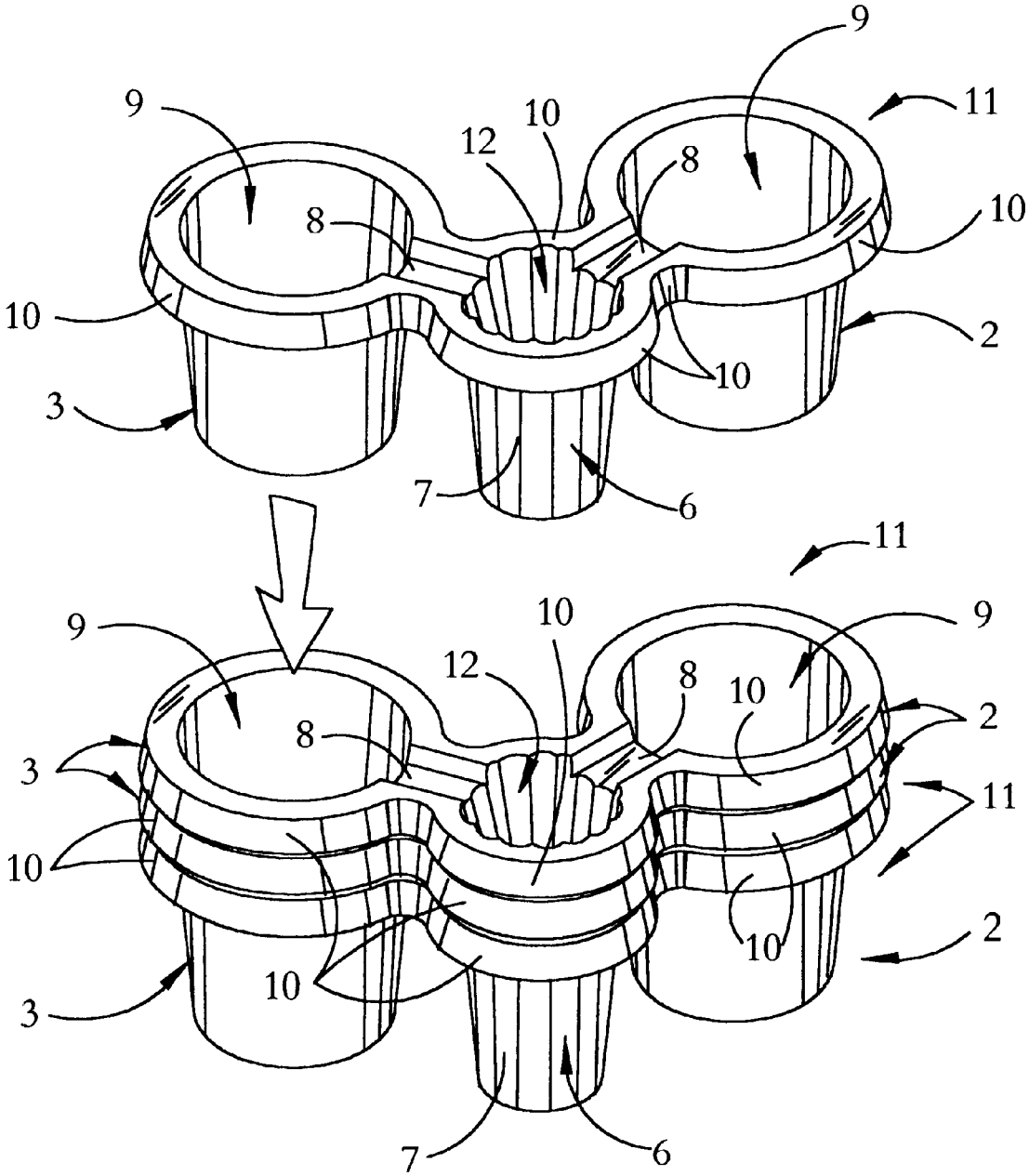
FIG. 11 is a perspective view of three nested dual-cup beverage container holders, with a fourth dual-cup beverage container holder positioned for nesting with the three in a stored configuration.

Referring next to FIGS. 11–15 of the drawings, in a preferred embodiment the dual-cup beverage container holder of this invention is generally illustrated by reference numeral 11. The dual-cup beverage container holder 11 is characterized by a first container cup 2 and a second container cup 3 which are joined to a common handle 6, typically in the same manner as described above with respect to the single-cup beverage container holders 1. As illustrated in FIG. 11, the first container cup 2 and second container cup 3 are typically disposed at an obtuse angle, typically about 120 degrees, with respect to each other on the handle 6. Accordingly, a glass, bottle, can, cup or other container (not illustrated) of beverage can be placed in the cup interior 9 of the first container cup 2 and second container cup 3, respectively, and carried by gripping the common handle 6 using one hand.

Figure 12:
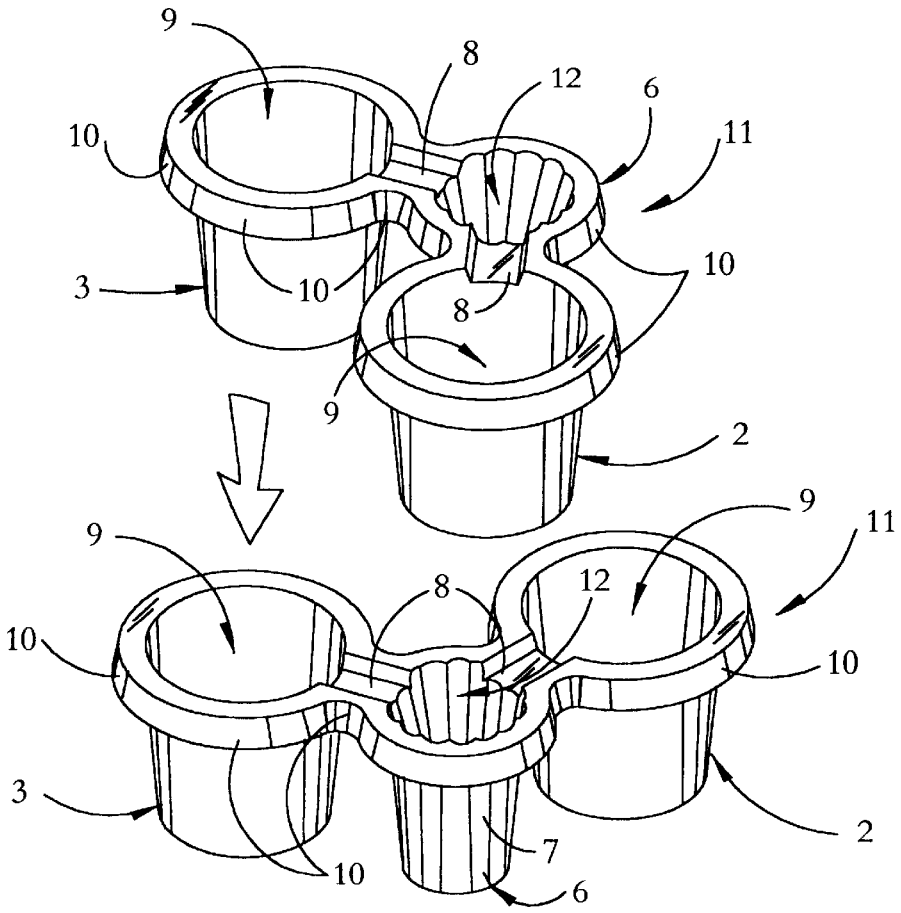
FIG. 12 is a perspective view of a pair of the dual-cup beverage container holders illustrated in FIG. 11, positioned for nesting in an alternative, functional nesting configuration.
Figure 13:
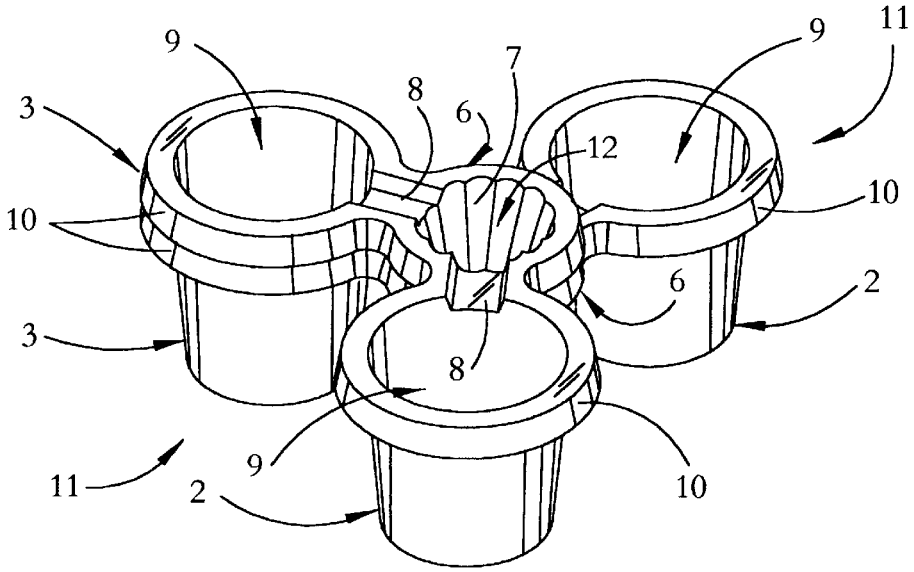
FIG. 13 is a perspective view of the dual-cup beverage container holders illustrated in FIG. 12, in functional nested configuration to facilitate the use of three radially-extending container cups.

As further illustrated in FIG. 11, two or more of the dual-cup beverage container holders 11 can be nested into a storage configuration, as needed, by inserting the handle 6 of each dual-cup beverage container holder 11 into the handle interior 12 of the handle 6 of an underlying dual-cup beverage container holder 11, and simultaneously inserting the first container cup 2 and second container cup 3 of each dual-cup beverage container holder 11 into the cup interiors 9 of the respective first container cup 2 and second container cup 3 of the underlying dual-cup beverage container holder 11. Alternatively, as illustrated in FIG. 13 two of the dual-cup beverage container holders 11 can be nested in functional configuration to form a nested assembly of the dual-cup beverage container holders 11, having a pair of first container cups 2 and a second container cup 3 available for receiving three respective beverages. Accordingly, as illustrated in FIG. 12 the handle 6 of one of the dual-cup beverage container holders 11 is inserted in the handle interior 12 of the handle 6 of an underlying dual-cup beverage container holder 11, with the serrations 7 of the upper dual-cup beverage container holder 11 inserted between the adjacent serrations 7 of the underlying dual-cup beverage container holder 11, as illustrated in FIG. 2. Simultaneously, the second container cup 3 of the upper dual-cup beverage container holder 11 is inserted in the cup interior 9 of the second container cup 3 of the underlying dual-cup beverage container holder 11, with the first container cup 2 of the upper dual-cup beverage container holder 11 disposed between the first container cup 2 and second container cup 3 of the underlying dual-cup beverage container holder 11. Accordingly, three beverage-filled bottles, cans, cups, glasses or other containers can be fitted in the respective first container cups 2 and second container cup 3, respectively, and carried using one hand by gripping the nested handles 6. It is understood that the handles 6 of one, two or three of the single-cup beverage container holders 1 (FIG. 8) can be nested with the handle 6 of a dual-cup beverage container holder 11, as desired, in order to provide a handle-nested variation of the dual-cup beverage container holder 11 which is capable of receiving three, four or five beverages, respectively.

Figure 14:
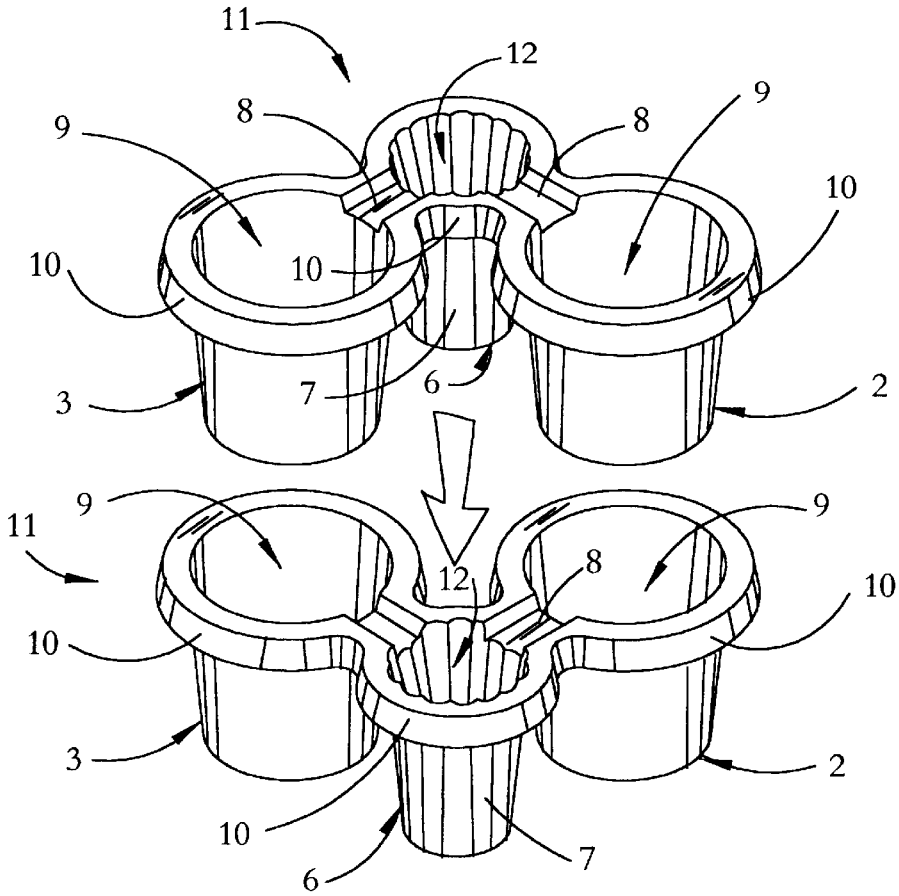
FIG. 14 is a perspective view of a pair of the dual-cup beverage container holders illustrated in FIG. 12, positioned for nesting in an alternative, functional nested configuration.
Figure 15:
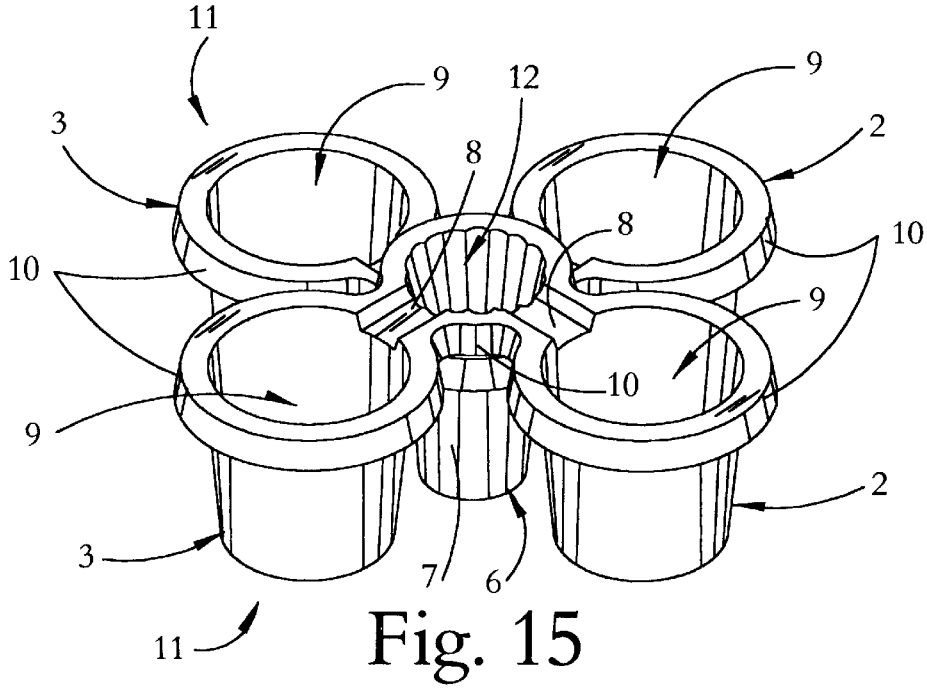
FIG. 15 is a perspective view of the dual-cup beverage container holders illustrated in FIG. 14, wherein four container cups extend radially from a common pair of nested handles.

As illustrated in FIGS. 14 and 15, it will be appreciated by those skilled in the art that a nested beverage container holder assembly for carrying four beverages using one hand can be formed using two of the dual-cup beverage container holders 11. This is accomplished by inserting the handle 6 of one of the dual-cup beverage container holders 11 into the handle interior 12 of the handle 6 of the underlying dual-cup beverage container holder 11, with the first container cup 2 of the upper dual-cup beverage container holder 11 positioned adjacent to the first container cup 2 of the underlying dual-cup beverage container holder 11, and the second container cup 3 of the upper dual-cup beverage container holder 11 positioned adjacent to the second container cup 3 of the underlying dual-cup beverage container holder 11. As heretofore described with respect to FIG. 2, the serrations 7 of the handle 6 of the upper dual-cup beverage container holder 11 interlock with the serrations 7 of the handle 6 of the underlying dual-cup beverage container holder 11, to prevent inadvertent rotation of the dual-cup beverage container holders 11 with respect to each other at the nested handles 6.

Figure 3:
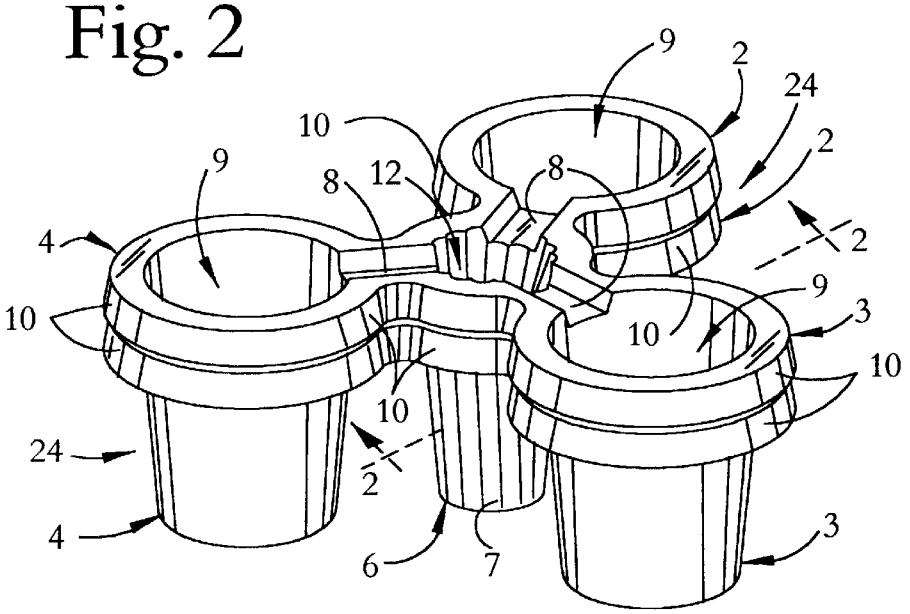
FIG. 3 is a perspective view of the three-cup beverage container holders illustrated in FIG. 1, in nested configuration for storage.

Referring next to FIGS. 1–5 of the drawings, in a preferred embodiment the three-cup beverage container holder of this invention is generally illustrated by reference numeral 24. The three-cup beverage container holder 24 is characterized by a first container cup 2, a second container cup 3 and a third container cup 4, which are joined in the same manner as described above with respect to the single-cup beverage container holder 1, to a common handle 6 at a typically 120 degree angle with respect to each other. The three-cup beverage container holder 24 can be used to carry three beverages in the respective first container cup 2, second container cup 3 and third container cup 4, by gripping and holding the handle 6. As illustrated in FIG. 3, two or more of the three-cup beverage container holders 24 can be nested in a storage configuration, as desired, by inserting the handle 6 of one of the three-cup beverage container holders 24 in the handle interior 12 of the handle 6 of the underlying three-cup beverage container holder 24. Simultaneously, the first container cup 2, second container cup 3 and third container cup 4 of the upper three-cup beverage container holder 24 are inserted in the respective first container cup 2, second container cup 3 and third container cup 4 of the underlying three-cup beverage container holder 24, as illustrated in FIG. 1.

Figure 4:
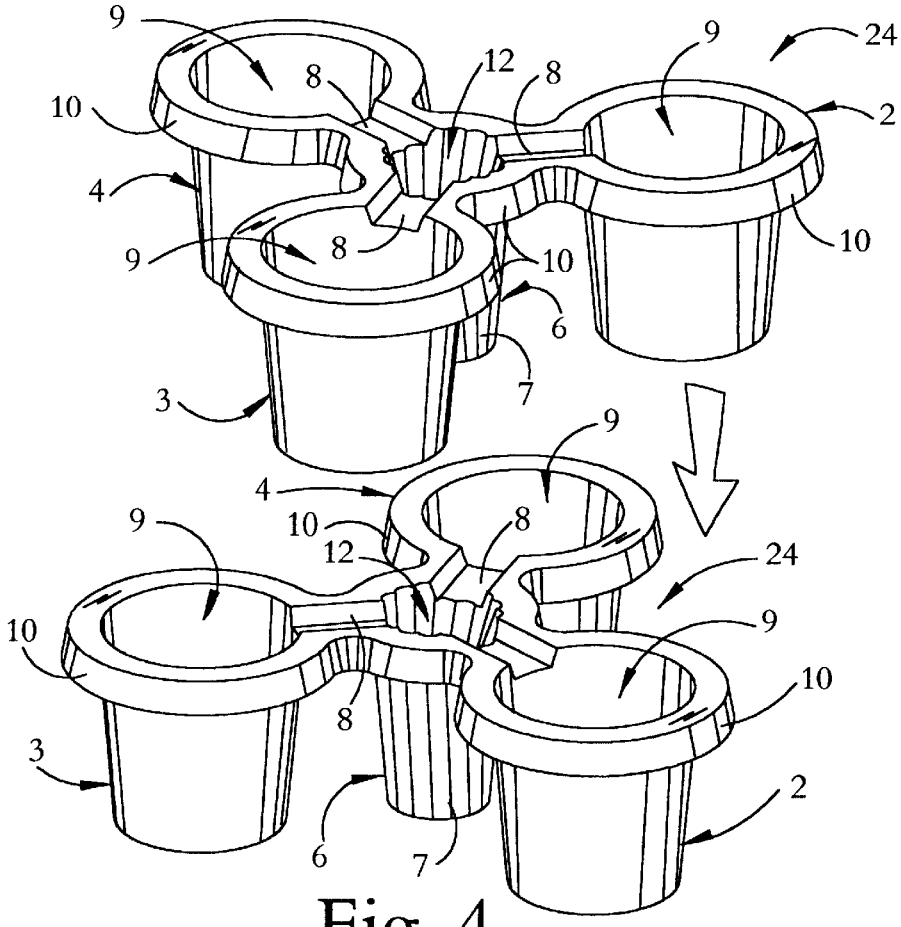
FIG. 4 is a perspective view of the three-cup beverage container holders illustrated in FIGS. 1 and 3, positioned for nesting in an alternative, functional configuration.
Figure 5:
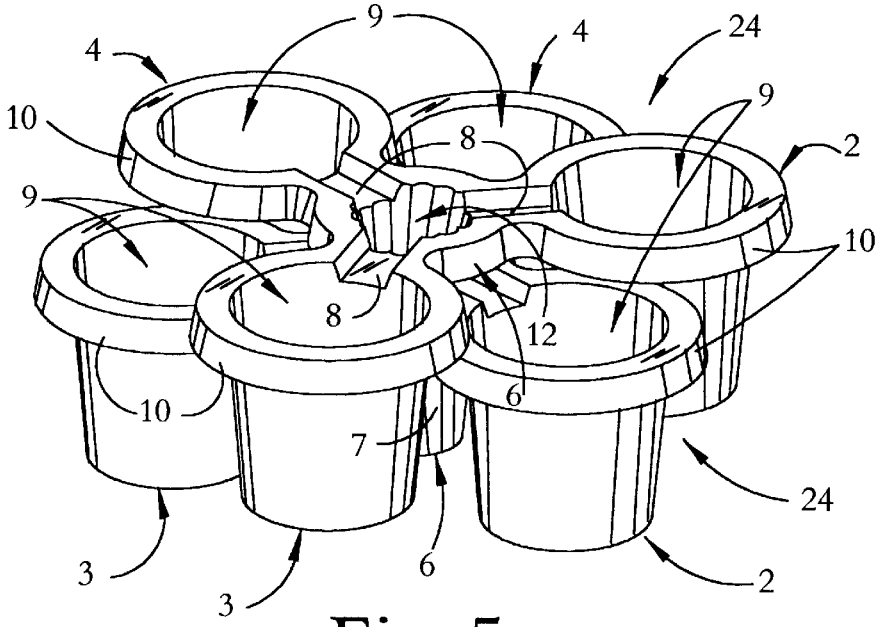
FIG. 5 is a perspective view of the three-cup beverage container holders illustrated in FIG. 4, in the functionally nested configuration to facilitate carrying six beverage cups, bottles, cans, glasses or other beverage containers (not illustrated) in the six container cups extending from a common nested handle configuration.

As illustrated in FIGS. 4 and 5, two of the three-cup beverage container holders 24 can be nested at the handles 6 thereof, to form a handle-nested assembly of the three-cup beverage container holders 24 which is capable of holding six beverages. Accordingly, the handle 6 of an upper three-cup beverage container holder 24 is inserted in the handle interior 12 of the handle 6 of an underlying three-cup beverage container holder 24, as illustrated in FIG. 4, with the serrations 7 of the handle 6 of the upper three-cup beverage container holder 24 interlocking with the serrations 7 of the handle 6 of the underlying three-cup beverage container holder 24, as heretofore described with respect to FIG. 2. The first container cup 2, second container cup 3 and third container cup 4 of the upper three-cup beverage container holder 24 are positioned between the respective adjacent pairs of the first container cup 2, second container cup 3 and third container cup 4 of the underlying three-cup beverage container holder 24. The first container cup 2, second container cup 3 and third container cup 4 of the upper three-cup beverage container holder 24 and of the underlying three-cup beverage container holder 24, respectively, each receives a beverage-containing bottle, can, cup, glass or other container, which can be securely carried by gripping and holding the nested handles 6, using one hand. Alternatively, the three-cup beverage container holder 24 can be converted to the six beverage-carrying assembly by nesting the handles 6 of three of the single-cup beverage container holders 1 (FIG. 8) in the handle interior 12 of the handle 6 of the three-cup beverage container holder 24, with the first container cups 2 of the respective single-cup beverage container holders 1 positioned between the respective first container cup 2, second container cup 3 and third container cup 4 of the three-cup beverage container holder 24. In like manner, a nested assembly for carrying five beverages can be formed using a pair of the single-cup beverage container holders 1 in handle-nested combination with the three-cup beverage container holder 24, or a dual-cup beverage container holder 11 in handle-nested combination with the three-cup beverage container holder 24.

Figure 6:
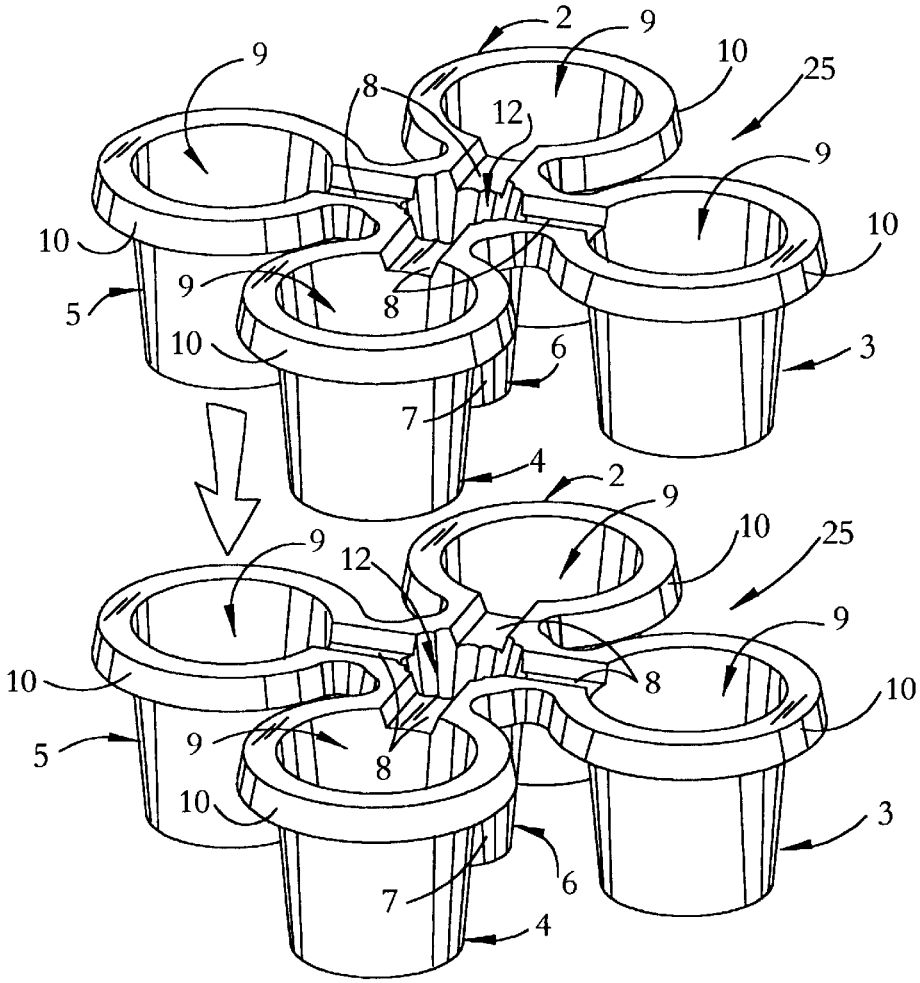
FIG. 6 is a perspective view of a pair of four-cup beverage container holders, positioned for nesting in storage configuration.
Figure 7:
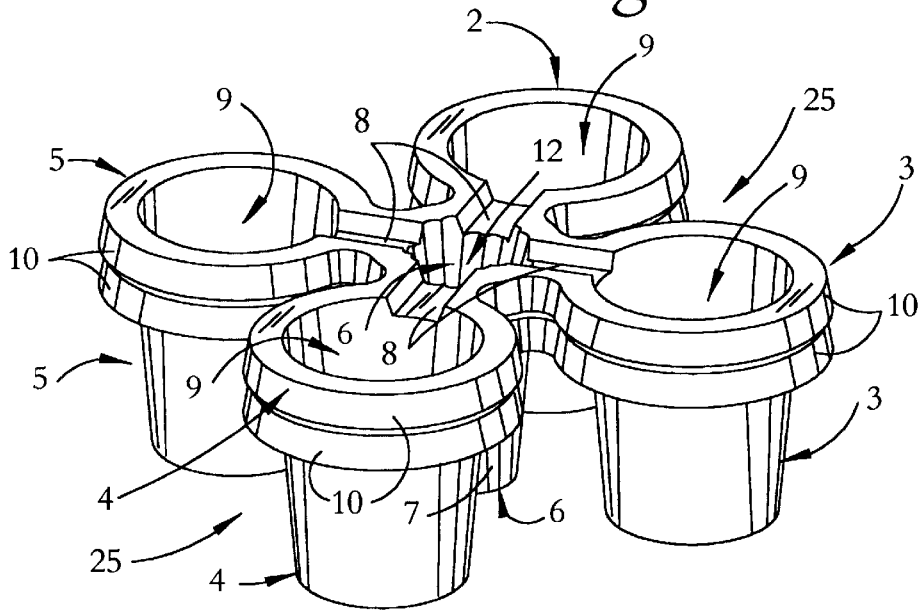
FIG. 7 is a perspective view of the four-cup beverage container holders illustrated in FIG. 6, in nested configuration for storage.

Referring next to FIGS. 6 and 7 of the drawings, in a preferred embodiment the four-cup beverage container holder of this invention is generally illustrated by reference numeral 25. The four-cup beverage container holder 25 is characterized by a first container cup 2, a second container cup 3, a third container cup 4 and a fourth container cup 5, connected to a common handle 6 typically in the same manner as described above with respect to the single-cup beverage container holder 1. Accordingly, four beverage-filled cups, cans, bottles, glasses or other containers (not illustrated) can be carried in the first container cup 2, second container cup 3, third container cup 4 and fourth container cup 5, respectively, by gripping and holding the common handle 6. As illustrated in FIGS. 6 and 7, two or more four-cup beverage container holders 25 can be nested in storage configuration, as desired, by inserting the handle 6 of one of the four-cup beverage container holders 25 into the handle interior 12 of the handle 6 of the underlying four-cup beverage container holder 25. The first container cup 2, second container cup 3, third container cup 4 and fourth container cup 5 of the upper four-cup beverage container holder 25 are inserted in the cup interiors 9 of the respective first container cup 2, second container cup 3, third container cup 4 and fourth container cup 5, respectively, of the underlying four-cup beverage container holder 25.

Figure 16:
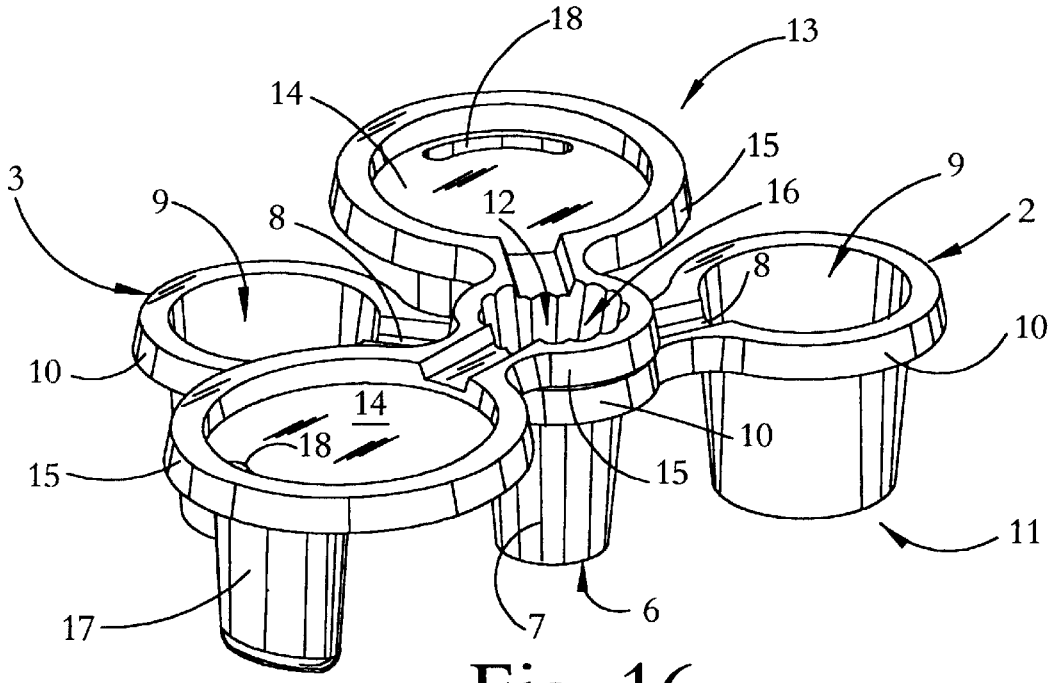
FIG. 16 is a perspective view of a dual tray of this invention, provided in nested configuration with one of the dual-cup beverage container holders illustrated in FIGS. 14 and 15.
Figure 17:
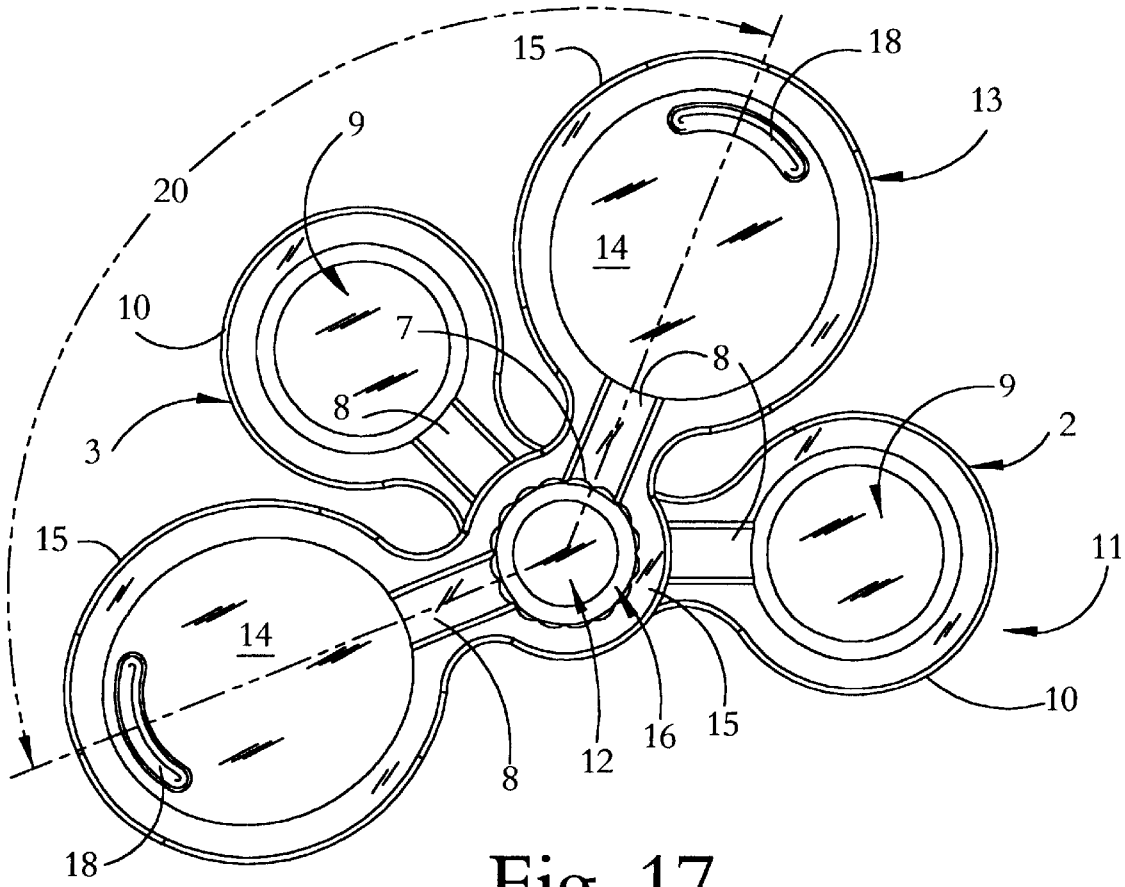
FIG. 17 is a top view of the dual-cup beverage container holder and nested dual tray illustrated in FIG. 16.

Referring next to FIGS. 16 and 17 of the drawings, in a preferred embodiment the dual tray of this invention is generally illustrated by reference numeral 13. The dual tray 13 is characterized by a tray handle 16, having a handle interior 12 and typically fitted with multiple serrations 7, spaced around the circumference of the tray handle 16. Two typically recessed, and/or planar and typically circular tray surfaces 14, each adapted for carrying a plate of food (not illustrated), are joined to the tray handle 16, typically by means of a continuous tray and handle border 15 which is shaped along the upper edges of the tray surfaces 14 and tray handle 16. A tray leg 17 typically protrudes downwardly from each tray surface 14 for supporting the dual tray 13 on a supporting surface (not illustrated), and a curved leg recess 18 typically extends through the tray surface 14, into each tray leg 17. As illustrated in FIG. 17, the tray surfaces 14 typically extend from the common tray handle 16 at a selected obtuse orientation angle 20, preferably about 120 degrees. The dual tray 13 can be used to carry one or two plates of food, as desired, on the respective tray surfaces 14 by gripping the tray handle 16 using one hand. Alternatively, as further illustrated in FIGS. 16 and 17, the tray handle 16 of the dual tray 13 can be nested in the handle 6 of a dual-cup beverage and container holder 11, as desired, to facilitate carrying one or two beverages in combination with one or two plates of food by gripping the handle 6 of the dual-cup beverage container holder 11 and nested tray handle 6 of the dual tray 13, using one hand. This is accomplished by inserting the tray handle 16 of the dual tray 13 into the handle interior 12 (FIG. 12) of the handle 6 of the underlying dual-cup beverage container holder 11, with the second container cup 3 of the dual-cup beverage container holder 11 disposed between the tray surfaces 14 of the overlying dual tray 13. Accordingly, a plate of food (not illustrated) can be placed on one or both of the tray surfaces 14, and a beverage-containing can, bottle, cup, glass or other container (not illustrated) placed in one or both of the first container cup 2 and second container cup 3, and carried with one hand by gripping the nesting handle 6 of the underlying dual cup beverage container holder 11. It is understood that a single-cup beverage container holder 1 can be handle-nested with the combination of the dual-cup beverage container holder 11 and dual tray 13 illustrated in FIGS. 16 and 17, with the first container cup 2 of the single-cup beverage container holder 1 positioned between the first container cup 2 of the dual-cup beverage container holder 11 and a tray surface 14 of the dual tray 13. Accordingly, the handle-nested assembly of the dual-cup beverage container holder 11, dual tray 13 and single-cup beverage container holder 1 can be used to carry up to two plates of food and three beverage-filled containers, as desired.

It will be appreciated by those skilled in the art that the beverage container holders of this invention are characterized by versatility, convenience and stability since the beverage container holders can be used either individually or in various handle-nested combinations to carry a selected number of beverages or both food and beverages with one hand, while freeing the other hand of the user to perform other tasks. The non-rotatable handle nesting of the beverage container holders, imparted by the interlocking serrations of the respective handles, prevents the nested handles from rotating with respect to each other and the container cups of the respective handle-nested beverage container holders from hitting one another and causing spillage of beverage from the carried beverage containers, as the nested handles are carried using one hand. The serrations also promote better gripping of the handles and the handle interior 12 of the top handle 6 can serve as a receptacle for such items as sugar and cream packets, stirring sticks and the like. The lightweight, typically durable plastic construction of the beverage container holders renders the beverage container holders easy to carry by persons of all ages, and the beverage container holders can be used multiple times. While specific beverage-carrying applications of the single-cup beverage container holder, dual-cup beverage container holder, three-cup beverage container holder and four-cup beverage container holder, both individually and in combination with each other, have been described above, it will be recognized and understood that multiple other combinations of the various beverage container holders are possible with or without the food-carrying dual tray for carrying a selected number of beverages with or without food.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. A nestable beverage container holder for selectively holding two beverage containers in one hand in non-nested configuration and for selectively nesting multiple ones of said beverage container holder in a stored nesting configuration and for selectively holding four beverage containers in one hand in a first nesting configuration and for selectively holding three beverage containers in one hand in a second nesting configuration, respectively, each of said beverage container holder comprising a tapered handle having a bottom and a plurality of substantially vertical anti-rotational grooves for removably interlocking nesting ones of said handle; two arms extending radially from said handle in spaced-apart, non-linear relationship with respect to each other, said arms defining an offset center of gravity at said handle of said beverage container holder; and two tapered container cups terminating said arms, respectively, each of said container cups having a bottom for holding beverage containers in said non-nested configuration and in said first nesting configuration and in said second nesting configuration, respectively, wherein said handle is substantially smaller in diameter than said container cups, respectively, and said bottom of said handle is disposed in substantially coplanar relationship with respect to said bottom of said container cups for selectively resting said beverage container holder on a flat surface in said non-nested configuration, said stored nesting configuration, said first nesting configuration and said second nesting configuration, respectively, and wherein said handle and said container cups of multiple ones of said beverage container holder are selectively nested with each other, respectively, in said stored nesting configuration, and said handle of each of a first two of said beverage container holder is selectively nested with the other while said container cups of each of said first two of said beverage container holder are disposed in non-nested configuration, for holding the four beverage containers in said first nesting configuration, and said handle of each of a second two of said beverage container holder is selectively nested with the other and one of said container cups of each of said second two of said beverage container holder is nested with the other while the other of said container cups of said second two of said beverage container holder are disposed in non-nested configuration, for holding the three beverage containers in said second nesting configuration.

2. Beverage container holders for selectively nesting in stored configuration and holding beverage containers in a non-nested configuration and in a first nesting configuration and in a second nesting configuration, respectively, each of said beverage container holders comprising a handle having a plurality of anti-rotational grooves; two arms extending radially from said handle in spaced-apart, non-linear relationship with respect to each other, said arms defining an offset center of gravity at said handle of said beverage container holders; and two container cups provided on said arms, respectively, for holding at least two beverage containers, respectively, with said handle substantially smaller in diameter than said two container cups, respectively, and wherein said plurality of anti-rotational grooves in said handle are disposed in a substantially vertical, removably interlocking configuration when said beverage container holders are disposed in said stored configuration and in said first nesting configuration and in said second nesting configuration, respectively; and wherein said handle and said container cups of multiple ones of said beverage container holders are selectively nested with each other to define said stored configuration; said handle of each of a first pair of said beverage container holders is nested with the other to define said first nesting configuration; and said handle of each of a second pair of said beverage container holders is nested with the other and one of said container cups in each of said second pair of said beverage container holders is nested with the other while the other ones of said container cups in said second pair of said beverage container holders are not nested together, to define said second nesting configuration, respectively, of said beverage container holders.

3. A method of selectively nesting beverage container holders and holding a selected number of beverage containers in at least one beverage holding configuration, comprising the steps of:

providing beverage container holders, each having a handle with multiple anti-rotational grooves, two arms extending radially from the handle in spaced-apart, non-linear relationship with respect to each other and a container cup provided on each of said arms, respectively;

selectively nesting the handles and the container cups of the respective beverage container holders into a stored configuration of the beverage container holders;

selectively nesting only the handles of two of the beverage container holders by engaging the anti-rotational grooves, respectively, in the handles for preventing rotation of the handles with respect to each other, and positioning the container cups of the beverage container holders in a first non-nested configuration for receiving four beverage containers; and selectively nesting the handles of two of the beverage container holders, nesting a first pair of the container cups of the beverage container holders and positioning a second pair of the container cups of the beverage container holders in a second non-nested configuration, respectively, for receiving three beverage containers.

* * * * *